US006739528B2

(12) United States Patent
Lorraine et al.

(10) Patent No.: US 6,739,528 B2
(45) Date of Patent: May 25, 2004

(54) COMPENSATOR ASSEMBLY HAVING A FLEXIBLE DIAPHRAGM AND AN INTERNAL FILLING TUBE FOR A FUEL INJECTOR AND METHOD

(75) Inventors: Jack Lorraine, Harrisburg, PA (US); Andreas Kappel, Brunnthal (DE); Enrico Ulivieri, Pisa (IT); Bernhard Gottlieb, Munich (DE); Bernhard Fischer, Toeging (DE)

(73) Assignee: Siemens Automotive Corporation, Auburn Hills, MI (US)

( * ) Notice: Subject to any disclaimer, the term of this patent is extended or adjusted under 35 U.S.C. 154(b) by 97 days.

(21) Appl. No.: 09/973,938

(22) Filed: Oct. 11, 2001

(65) Prior Publication Data

US 2002/0139863 A1 Oct. 3, 2002

Related U.S. Application Data

(60) Provisional application No. 60/239,290, filed on Oct. 11, 2000.

(51) Int. Cl.[7] ..... F02M 51/00

(52) U.S. Cl. ..... 239/585.1; 239/533.7; 251/129.06

(58) Field of Search ..... 239/102.2, 533.7, 239/533.9, 533.11, 585.1–585.5; 251/129.06

(56) References Cited

U.S. PATENT DOCUMENTS

| | | | | |
|---|---|---|---|---|
| 3,753,426 | A | 8/1973 | Lilley | 123/139 E |
| 4,499,878 | A | 2/1985 | Igashira et al. | 123/478 |
| 4,529,164 | A | 7/1985 | Igashira et al. | 251/129 |

(List continued on next page.)

FOREIGN PATENT DOCUMENTS

| | | | |
|---|---|---|---|
| DE | 197 08 304 | | 9/1998 |
| DE | 19727992 | A | 1/1999 |
| DE | 197 27 992 | | 1/1999 |
| DE | 198 26 339 | | 12/1999 |
| DE | 19838862 | A1 | 3/2000 |
| DE | 198 38 862 | | 3/2000 |
| DE | 19854506 | C1 | 4/2000 |
| DE | 198 54 506 | | 4/2000 |
| DE | 198 56 617 | | 6/2000 |
| DE | 19858476 | A1 | 6/2000 |
| DE | 198 58 476 | | 6/2000 |
| DE | 199 02 260 | | 9/2000 |
| DE | 199 11 048 | | 9/2000 |
| EP | 0 869 278 | | 10/1998 |
| EP | 0869278 | A1 | 10/1998 |
| JP | 63-158301 | | 7/1998 |
| WO | WO 94/18449 | | 8/1994 |

OTHER PUBLICATIONS

PCT S01/31850; International Search Report, Feb. 2, 2002.

International Search Report for PCT/US01/31847.

*Primary Examiner*—Michael Mar
*Assistant Examiner*—Thach H Bui

(57) ABSTRACT

A fuel injector comprises a body having a longitudinal axis, a length-changing actuator that has first and second ends, a closure member coupled to the first end of the length-changing actuator, and a compensator assembly coupled the second end of the actuator. The length-changing actuator includes first and second ends. The closure member is movable between a first configuration permitting fuel injection and a second configuration preventing fuel injection. And the compensator assembly axially positions the actuator with respect to the body in response to temperature variation. The compensator assembly utilizes a configuration of at least one spring disposed between two pistons so as to reduce the-use of elastomer seals to thereby reduce a slip stick effect. Also, a method of compensating for thermal expansion or contraction of the fuel injector comprises providing fuel from a fuel supply to the fuel injector; and adjusting the actuator with respect to the body in response to temperature variation.

31 Claims, 5 Drawing Sheets

U.S. PATENT DOCUMENTS 4,550,744 A 11/1985 Igashira et al. ..... 137/80
4,553,059 A 11/1985 Abe et al. ..... 310/328
4,584,980 A 4/1986 Weiger et al. ..... 123/629
4,608,958 A 9/1986 Sakakibara et al. ..... 123/605
4,610,426 A 9/1986 Brandner
4,649,886 A 3/1987 Igashira et al. ..... 123/498
4,725,002 A 2/1988 Trachte ..... 239/102.2
4,735,185 A 4/1988 Imoto et al. ..... 123/498
4,750,706 A 6/1988 Schlagmüller ..... 251/129
4,803,393 A 2/1989 Takahashi
5,036,821 A 8/1991 Horiuchi et al. ..... 123/506
5,080,079 A 1/1992 Yoshida et al. ..... 123/531
5,176,122 A 1/1993 Ito ..... 123/478
5,548,263 A 8/1996 Bulgatz et al. ..... 335/274
5,605,134 A 2/1997 Martin ..... 123/467
5,647,311 A 7/1997 Liang et al. ..... 123/90.11
5,779,149 A 7/1998 Hayes, Jr. ..... 239/124
5,810,255 A 9/1998 Itoh et al. ..... 239/102.2
6,006,720 A 12/1999 Yanagihara et al. ..... 123/305
6,047,673 A 4/2000 Lohse et al. ..... 123/90.11
6,047,948 A 4/2000 Hasegawa et al. ..... 251/129.18
6,062,533 A 5/2000 Kappel et al. ..... 251/57
6,070,853 A 6/2000 Stolk et al. ..... 251/129.18
6,142,443 A 11/2000 Potschin et al. ..... 251/57
6,148,842 A 11/2000 Kappel et al. ..... 137/79
6,155,532 A 12/2000 Heinz et al. ..... 251/57
6,168,133 B1 1/2001 Heinz et al. ..... 251/57
6,213,414 B1 4/2001 Stier et al. ..... 239/584
6,260,541 B1 7/2001 Ricci-Ottati et al. ..... 123/498
6,313,568 B1 11/2001 Sullivan et al. ..... 310/346

COMPENSATOR ASSEMBLY HAVING A FLEXIBLE DIAPHRAGM AND AN INTERNAL FILLING TUBE FOR A FUEL INJECTOR AND METHOD

PRIORITY

This application claims the benefits of provisional application Ser. No. 60/239,290 filed on Oct. 11, 2000, which is hereby incorporated by reference in its entirety in this application.

FIELD OF THE INVENTION

The invention generally relates to length-changing electromechanical solid state actuators such as an electrorestrictive, magnetorestrictive or solid-state actuator. In particular, the present invention relates to a compensator assembly for a length-changing actuator, and more particularly to an apparatus and method for hydraulically compensating a piezoelectrically actuated high-pressure fuel injector for internal combustion engines

BACKGROUND OF THE INVENTION

A known solid-state actuator includes a ceramic structure whose axial length can change through the application of an operating voltage or magnetic field. It is believed that in typical applications, the axial length can change by, for example, approximately 0.12%. In a stacked configuration of piezoelectric elements of a solid-state actuator, it is believed that the change in the axial length is magnified as a function of the number of elements in the actuator. Because of the nature of the solid-state actuator, it is believed that a voltage application results in an instantaneous expansion of the actuator and an instantaneous movement of any structure connected to the actuator. In the field of automotive technology, especially, in internal combustion engines, it is believed that there is a need for the precise opening and closing of an injector valve element for optimizing the spray and combustion of fuel. Therefore, in internal combustion engines, it is believed that solid-state actuators are now employed for the precise opening and closing of the injector valve element.

During operation, it is believed that the components of an internal combustion engine experience significant thermal fluctuations that result in the thermal expansion or contraction of the engine components. For example, it is believed that a fuel injector assembly includes a valve body that may expand during operation due to the heat generated by the engine. Moreover, it is believed that a valve element operating within the valve body may contract due to contact with relatively cold fuel. If a solid state actuator is used for the opening and closing of an injector valve element, it is believed that the thermal fluctuations can result in valve element movements that can be characterized as an insufficient opening stroke, or an insufficient sealing stroke. It is believed that this is because of the low thermal expansion characteristics of the solid-state actuator as compared to the thermal expansion characteristics of other fuel injector or engine components. For example, it is believed that a difference in thermal expansion of the housing and actuator stack can be more than the stroke of the actuator stack. Therefore, it is believed that any contractions or expansions of a valve element can have a significant effect on fuel injector operation.

It is believed that conventional methods and apparatuses that compensate for thermal changes affecting solid state actuator operation have drawbacks in that they either only approximate the change in length, they only provide one length change compensation for the solid state actuator, or that they only accurately approximate the change in length of the solid state actuator for a narrow range of temperature changes.

It is believed that there is a need to provide thermal compensation that overcomes the drawbacks of conventional methods.

SUMMARY OF THE INVENTION

The present invention provides a fuel injector that utilizes a length-changing actuator, such as, for example, an electrorestrictive, magnetorestrictive or a solid-state actuator with a compensator assembly that compensates for distortions, brinelling, wear and mounting distortions. The compensator assembly utilizes a minimal number of elastomer seals so as to reduce a slip stick effect of such seals while achieving a more compact configuration of the compensator assembly. In one preferred embodiment of the invention, the fuel injector comprises a housing having a first housing end and a second housing end extending along a longitudinal axis, the housing having an end member disposed between the first and second housing ends, a length-changing actuator disposed along the longitudinal axis, a closure member coupled to the length-changing actuator, the closure member being movable between a first configuration permitting fuel injection and a second configuration preventing fuel injection, and a compensator assembly that moves the solid-state actuator with respect to the body in response to temperature changes. The compensator assembly includes a body having a first body end and a second body end extending along a longitudinal axis, the body having an inner surface facing the longitudinal axis, a first piston coupled to the length-changing actuator and disposed in the body proximate one of the first body end and second body end, a second piston disposed in the body proximate the first piston. The first piston has a first outer surface and a first working surface distal to the first outer surface, the first outer surface cooperating with the end member of the housing of the fuel injector to define a first fluid reservoir in the body. The second piston has a second outer surface distal to a second working surface that confronts the first working surface of the first piston. A second fluid reservoir is disposed between the first working surface and the second working surface, a communication passage being disposed between the first fluid reservoir and the second fluid reservoir, and an extension portion having a first extension end coupled to one of the first piston and second piston and a second extension end coupled to the length-changing actuator. The extension portion includes a fill passage disposed within the extension portion so as to supply hydraulic fluid to the communication passage and the first and second fluid reservoirs.

The present invention provides a compensator that can be used in a length-changing actuator, such as, for example, an electrorestrictive, magnetorestrictive or a solid-state actuator so as to compensate for thermal distortion, wear, brinelling and mounting distortion of an actuator that the compensator is coupled to. In a preferred embodiment, the length-changing actuator has first and second ends. The thermal compensator comprises an end member, a body having a first body end and a second body end extending along a longitudinal axis, the body having an inner surface facing the longitudinal axis, a first piston coupled to the length-changing actuator and disposed in the body proximate one of the first body end and second body end, a second piston disposed in the body proximate the first piston. The first piston has a first outer surface and a first working surface distal to the first outer surface, the first outer surface cooperating with the end member of the housing of the fuel injector to define a first fluid reservoir in the body. The second piston has a second outer surface distal to a second working surface that confronts the first working surface of the first piston. A second fluid reservoir is disposed between the first working surface and the second working surface, a communication passage being disposed between the first fluid reservoir and the second fluid reservoir, and an extension portion having a first extension end coupled to one of the first piston and second piston and a second extension end coupled to the length-changing actuator. The extension portion includes a fill passage disposed within the extension portion so as to supply hydraulic fluid to the communication passage and the first and second fluid reservoirs.

The present invention further provides a method of compensating for distortion of a fuel injector due to thermal distortion, brinelling, wear and mounting distortion. In particular, the actuator includes a fuel injection valve or a fuel injector that incorporates a length-changing actuator such as, for example, an electrorestrictive, magnetorestrictive, piezoelectric or solid state actuator. A preferred embodiment of the length-changing actuator includes a solid-state actuator that actuates a closure member of the fuel injector. The fuel injector includes a housing having an end member, a body, the body having an inner surface facing the longitudinal axis, a first piston coupled to the length-changing actuator and disposed in the body, the first piston having a first outer surface and a first working surface distal to the first outer surface, the first outer surface cooperating with the end member of the housing of the fuel injector to define a first fluid reservoir in the body, a second piston disposed in the body proximate the first piston. A second fluid reservoir is disposed between the first working surface and the second working surface. A communication passage is disposed between the first fluid reservoir and the second fluid reservoir, and an extension portion coupled to one of the first piston and second piston. The extension portion includes a fill passage disposed within the extension portion so as to supply hydraulic fluid to the communication passage and the first and second fluid reservoirs. In a preferred embodiment, the method is achieved by confronting a surface of the first piston to an inner surface of the body so as to form a controlled clearance between the first piston and the body inner surface; coupling an flexible fluid barrier between the first piston and the second piston such that the second piston, the elastomer and the flexible fluid barrier form the second fluid reservoir; biasing the second piston being disposed at least partly within the outer shell of the piston skirt so as to generate a hydraulic pressure in the first and second hydraulic reservoirs; and biasing the length-changing actuator with a predetermined vector resulting from changes in the volume of hydraulic fluid disposed within the first fluid reservoir as a function of temperature.

BRIEF DESCRIPTION OF THE DRAWINGS

The accompanying drawings, which are incorporated herein and constitute part of this specification, illustrate presently preferred embodiments of the invention, and, together with the general description given above and the detailed description given below, serve to explain features of the invention.

DETAILED DESCRIPTION OF THE PREFERRED EMBODIMENTS

Figure 1:
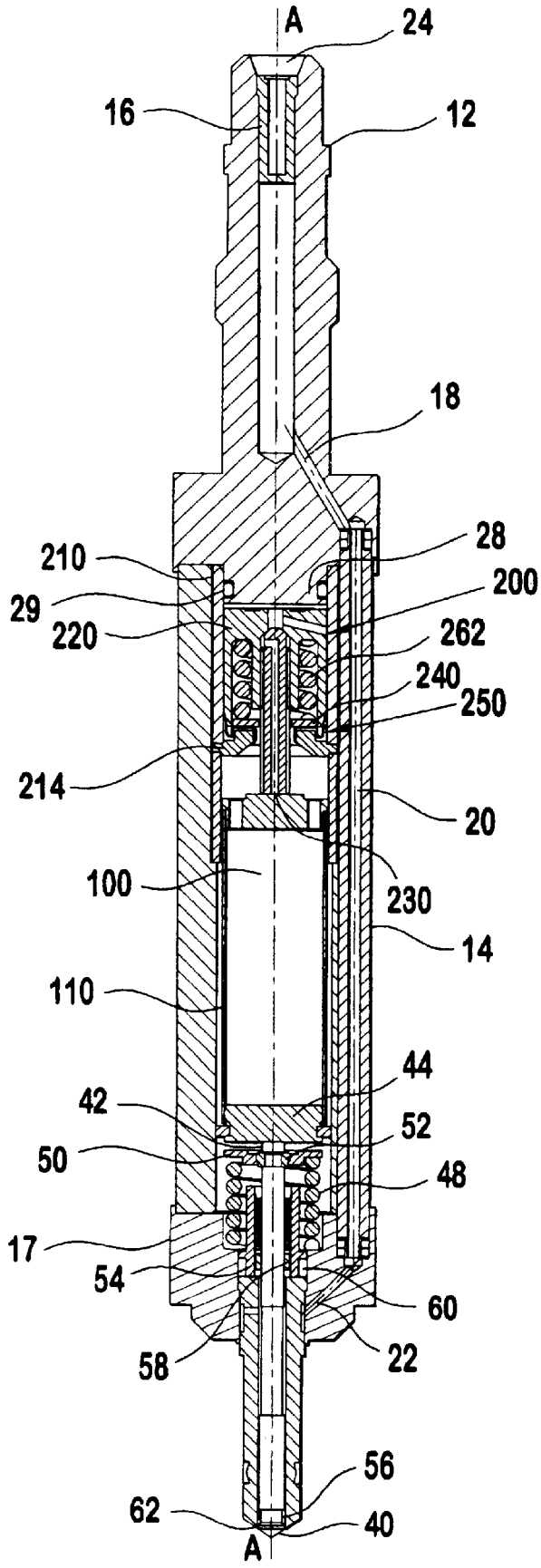
FIG. 1 is a cross-sectional view of a fuel injector assembly having a solid-state actuator and a compensator assembly of a preferred embodiment.

Referring to FIGS. 1–4, a plurality of preferred embodiments is shown of a thermal compensator assembly. In particular, FIG. 1 illustrates a preferred embodiment of a fuel injector assembly 10 having a solid-state actuator that, preferably, includes a solid-state actuator stack 100 and a compensator assembly 200 for the stack 100. The fuel injector assembly 10 includes inlet fitting 12, injector housing 14, and valve body 17. The inlet fitting 12 includes a fuel filter 11, fuel passageways 18, 20 and 22, and a fuel inlet 24 connected to a fuel source (not shown). The inlet fitting 12 also includes an inlet end member 28. The fluid 36 can be a substantially incompressible fluid that is responsive to temperature change by changing its volume. Preferably, the fluid 36 is either silicon or other types of hydraulic fluid that has a higher coefficient of thermal expansion than that of the injector inlet 16, the housing 14 or other components of the fuel injector.

In the preferred embodiment, injector housing 14 encloses the solid-state actuator stack 100 and the compensator assembly 200. Valve body 17 is fixedly connected to injector housing 14 and encloses a valve closure member 40. The solid-state actuator stack 100 includes a plurality of solid-state actuators that can be operated through contact pins (not shown) that are electrically connected to a voltage source. When a voltage is applied between the contact pins (not shown), the solid-state actuator stack 100 expands in a lengthwise direction. A typical expansion of the solid-state actuator stack 100 may be on the order of approximately 30–50 microns, for example. The lengthwise expansion can be utilized for operating the injection valve closure member 40 for the fuel injector assembly 10. That is, the lengthwise expansion of the stack 100 and the closure member 40 can be used to define an orifice size of the fuel injector as opposed to an orifice of a valve seat or an orifice plate as is used in a conventional fuel injector.

Solid-state actuator stack 100 is guided along housing 14 by means of guides 110. The solid-state actuator stack 100 has a first end in operative contact with a closure end 42 of the valve closure member 40 by means of bottom 44, and a second end of the stack 100 that is operatively connected to compensator assembly 200 by means of a top 46.

Fuel injector assembly 10 further includes a spring 48, a spring washer 50, a keeper 52, a bushing 54, a valve closure member seat 56, a bellows 58, and an O-ring 60. O-ring 60 is, preferably, a fuel compatible O-ring that remains operational at low ambient temperatures (–40 Celsius or less) and at operating temperatures (140 Celsius or more).

Figure 2A:
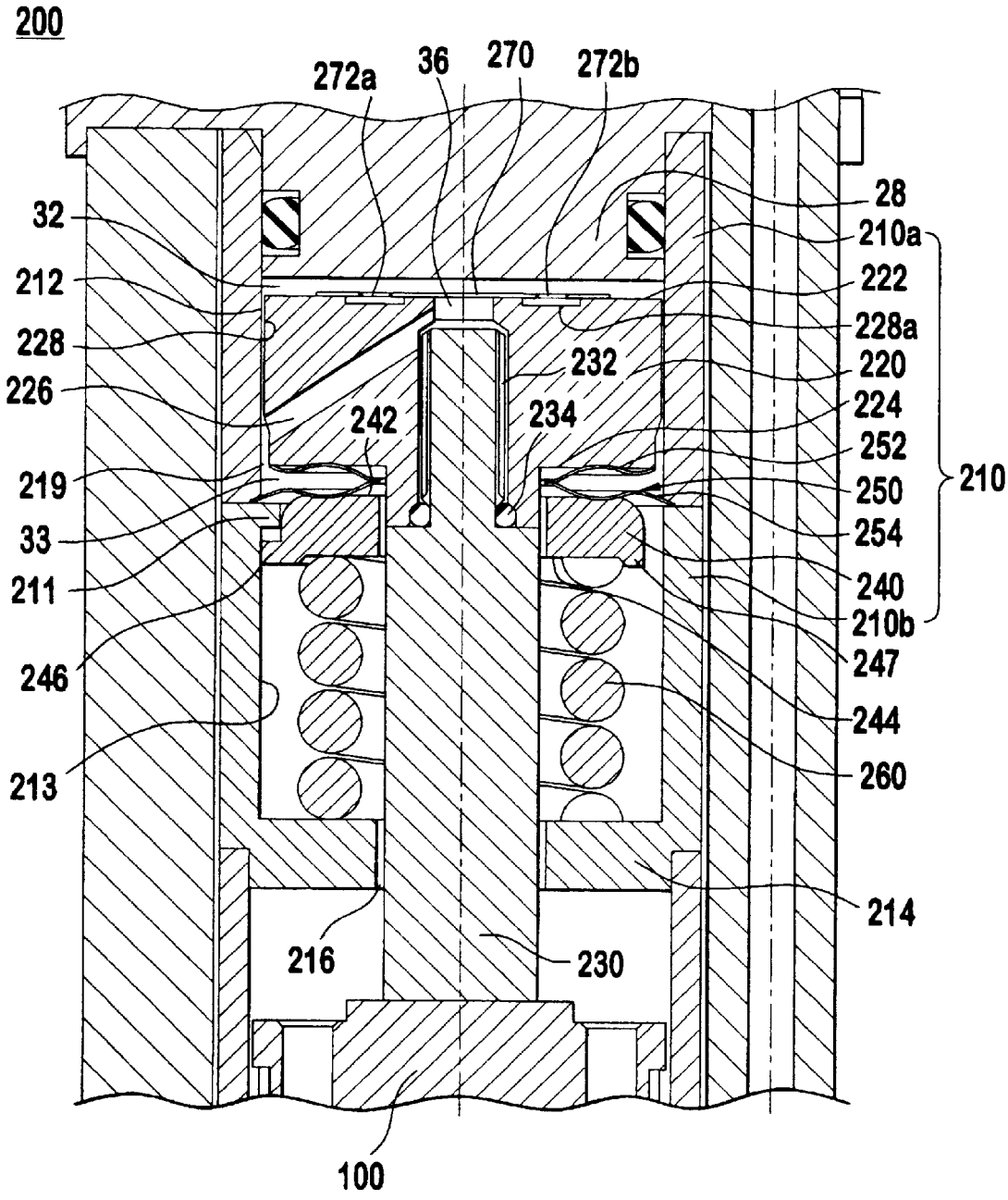
FIG. 2A is an enlarged view of the thermal compensator assembly in FIG. 1.
Figure 2B:
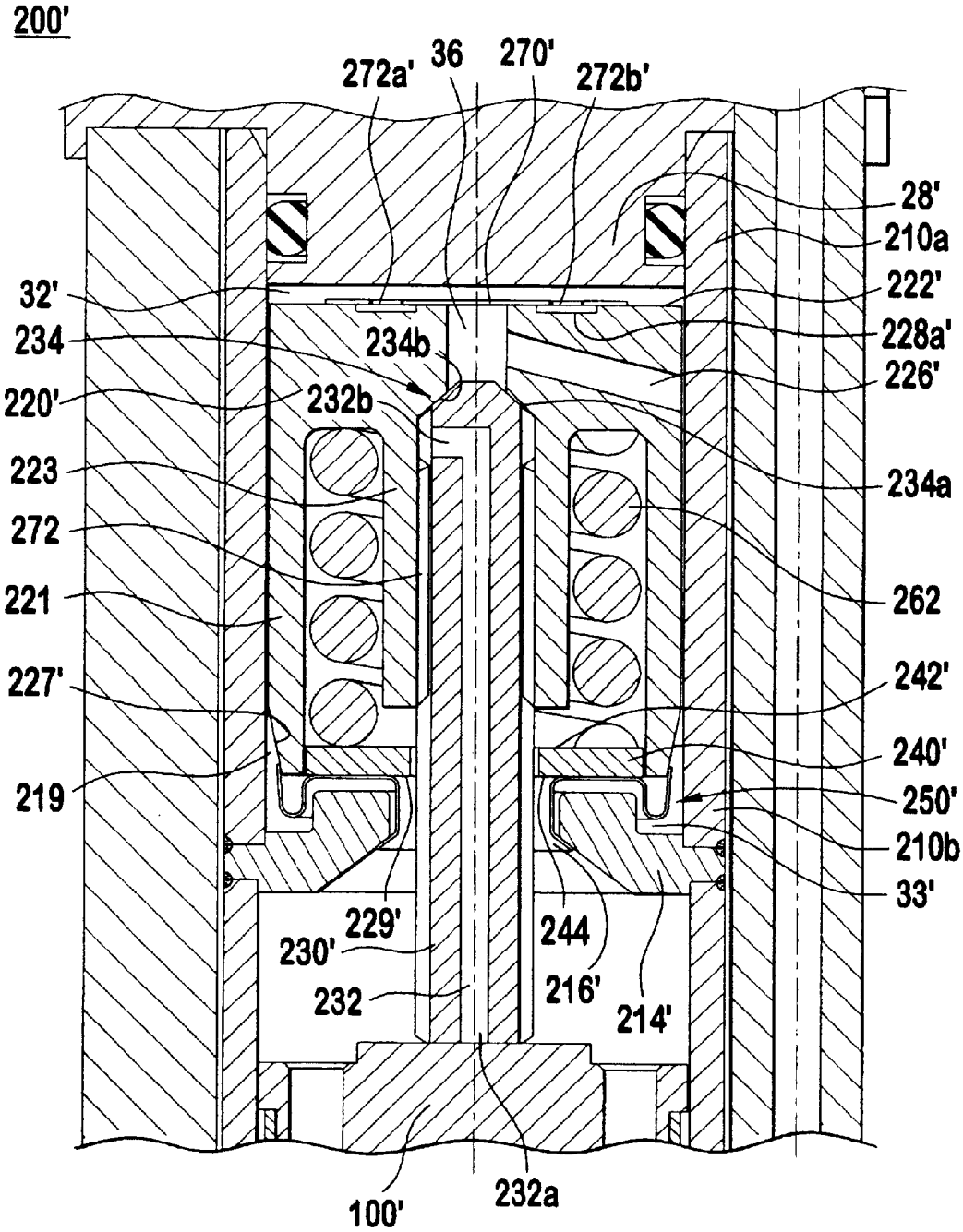
FIG. 2B is an enlarged view of another preferred embodiment of the thermal compensator assembly.

As used herein, elements having similar features are denoted by the same reference number and can be differentiated between FIG. 2A and FIG. 2B by a prime notation. Referring to FIG. 2A, compensator assembly 200 includes a body 210 having a first body end 210*a* and a second body end 210*b*. The second body end 210*b* includes an end cap 214 with an opening 216. The end cap 214 can be a portion that can extend, transversely or obliquely with respect to the longitudinal axis A—A, from the inner surface 213 of the body 210 towards the longitudinal axis. Alternatively, the end cap 214 can be of a separate portion affixed to the body 210. Preferably, the end cap 214 is formed as part of the second end 210*b* of the body 210, which end cap 214 extends transversely with respect to the longitudinal axis A—A.

The body 210 encases a first piston 220, part of a piston stem or an extension portion 230, a second piston 240, a flexible diaphragm 250 and an elastic member or spring 260 located between the second piston 240 and the end cap 214. The first body end 210*a* and second body end 210*b* can be of any suitable cross-sectional shape as long as it provides a mating fit with the first and second pistons, such as, for example, oval, square, rectangular or any suitable polygons. Preferably, the cross section of the body 210 is circular, thereby forming a cylindrical body that extends along the longitudinal axis A—A. The body 210 can also be formed by coupling two separate portions together (FIG. 2A), or by forming the body from a continuous piece of material (FIG. 2B) as shown here in the preferred embodiments.

The extension portion 230 extends from the first piston 220 so as to be linked to the top 46 of the piezoelectric stack 100. Preferably, the extension portion is formed as a separate piece from the first piston 220, and coupled to the first piston 220 by a spline coupling 272. Other suitable couplings can also be used, such as, for example, a ball joint, a heim joint or any other couplings that allow two moving parts to be coupled together. Alternatively, the extension portion 230 can be integrally formed as a single piece with the first piston 220.

In a preferred embodiment (FIG. 2B), a separate extension portion 230 is configured with an internal fill passage 232 that is disposed within the extension portion 230. The fill passage 232 extends from a first fill end 232*a* through generally the whole length of the extension portion 230 to a second fill end 232*b*. The first fill end 232*a* is generally a port that has its axis along the same axis as the fill passage 232 or the longitudinal axis A—A. The second fill end 232*b* is generally a port having an axis transverse to the fill passage or the longitudinal axis A—A. The cross-sections of the fill passage and ports can be of a suitable cross-section, such as, for example, circular, oval, square, or rectangular. Preferably the respective cross-sections are circular in shape.

One of the many benefits of the internal fill passage 232 (or 332) is the ability to fill the compensator with minimal amount of fluid without overfilling the compensator. In particular, the thermal compensator 200 or 200', 300 can be fully assembled and placed in the injector housing 14 but without the actuator or stack 100. As the fluid 36, preferably a silicone oil (Baysilone™ M350), has an affinity for gas or air, the partially assembled fuel injector is then placed in a chamber that can be placed under a vacuum (approximately −28 milliBar) so as to minimize any air or gas that can dissolve in the fluid 36 prior to filling of the compensator 200 or 200', 300 with the fluid 36. As the fluid 36 flows through the internal fill passage 230, the first reservoir and the second reservoir become filled with fluid 36. Since the fluid 36 is substantially incompressible, it displaces the first piston 220 towards the outlet end. As the first piston 220 moves toward the outlet end, a chamfer 234*a* on the piston side mates with a chamfer 234*b* on the extension portion side, thereby forming a seal 234 that prevents egress or ingress of fluid 36 into or out of the compensator. The stack 100 may now be installed in the injector housing 14 while still under a vacuum. Once the vacuum is removed, the first piston 220 expands tight against the extension portion so as to form a generally fluid tight seal with the chamfer seal 234. Alternatively, an elastomeric seal 234 can be mounted in a groove formed between the first piston 220 and the extension portion 230 so as to provide another seal against leakage of the fluid 36.

First piston 220 is disposed in a confronting arrangement with the inlet end member 28. An outer peripheral surface 228 of the first piston 220 is dimensioned so as to form a close tolerance fit with a body inner surface 212, i.e. a controlled clearance that allows lubrication of the piston and the body while also forming a hydraulic seal that controls the amount of fluid leakage through the clearance. The controlled clearance between the first piston 220 and body 210 provides a controlled leakage flow path from the first fluid reservoir 32 to the second fluid reservoir 33, and reduces friction between the first piston 220 and the body 210, thereby minimizing hysteresis in the movement of the first piston 220. It is believed that side loads introduced by the stack 100 would increase the friction and hysteresis. As such, the first piston 220 is coupled to the stack 100 only in the direction along the longitudinal axis A—A so as to reduce or even eliminate any side loads. The body 210 is preferably affixed to the injector housing at a first end 210*a* so as to be semi-free floating relative to the injector housing. Alternatively, the body 210 can be permitted to float in an axial direction within the injector housing. Furthermore, by having a spring contained within the piston subassembly, little or no external side forces or moments are introduced by the compensator assembly 200 (200' or 300) to the injector housing. Thus, it is believed that these features operate to reduce or even prevent distortion of the injector housing.

Pockets or channels 228*a* can be formed on the first face 222 that are in fluid communication with the second fluid reservoir 33 via the passage 226. The pockets 228*a* ensure that some fluid 36 can remain on the first face 222 to act as a hydraulic "shim" even when there is little or no fluid between the first face 222 and the end member 28. In a preferred embodiment, the first reservoir 32 always has at least some fluid disposed therein. The first face 222 and the second face 224 can be of any shapes such as, for example, a conic surface of revolution, a frustoconical surface or a planar surface. Preferably, the first face 222 and second face 224 include a planar surface transverse to the longitudinal axis A—A.

To permit fluid 36 to selectively circulate between a first face 222 of the first piston 220 and a second face 224 of the first piston 220, a passage 226 extends between the first and second faces. Facilitating the flow of fluid 36 between the passage 226 and the reservoirs is a gap 229 formed by a reduced portion 227 of the first piston 220 located on an outer peripheral surface of the piston 220. The gap 229 allows fluid 36 to flow out of passage 226 and into the second reservoir 33.

Figure 3:
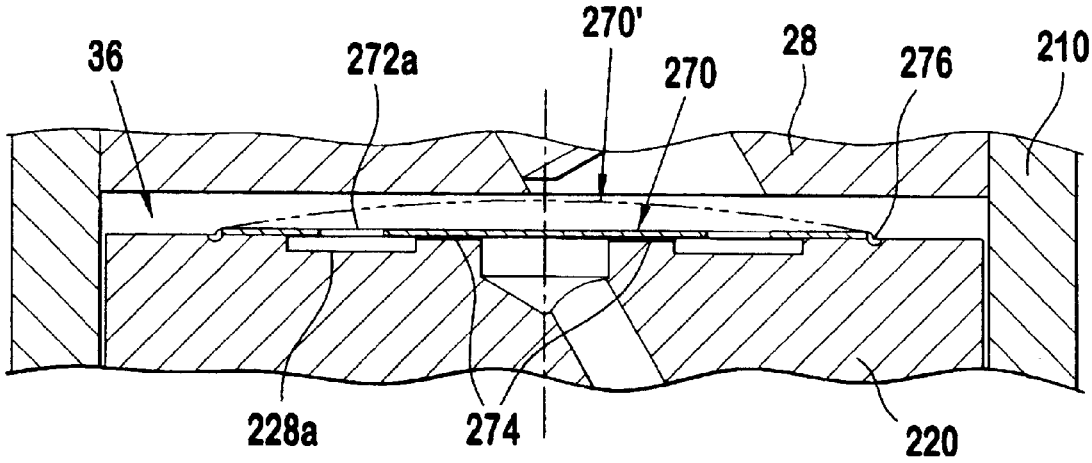
FIG. 3 is an illustration of the operation of the pressure sensitive valve of FIGS. 2A or 2B.

A pressure sensitive valve is disposed in the first fluid reservoir 32 that allows fluid flow in one direction, depending on the pressure drop across the pressure sensitive valve (FIG. 3). The pressure sensitive valve can be, for example, a check valve or a one-way valve. Preferably, the pressure sensitive valve is a flexible thin-disc plate 270 having a smooth surface disposed atop the first face 222.

Specifically, by having a smooth surface on the side contiguous to the first piston 220 that forms a sealing surface with the first face 222, the plate 270 functions as a pressure sensitive valve that allows fluid to flow between a first fluid reservoir 32 (or 32') and a second fluid reservoir 33 (or 33')

whenever pressure in the first fluid reservoir 32 (or 32') is less than pressure in the second reservoir 33 (or 33'). That is, whenever there is a pressure differential between the reservoirs, the smooth surface of the plate 270 is lifted up to allow fluid to flow to the channels or pockets 228*a* (or 228*a'*). It should be noted here that the plate forms a seal to prevent flow as a function of the pressure differential instead of a combination of fluid pressure and spring force as in a ball type check valve. The pressure sensitive valve or plate 270 includes orifices 272*a* and 272*b* formed through its surface. The orifice can be, for example, square, circular or any suitable through orifice. Preferably, there are twelve orifices formed through the plate with each orifice having a diameter of approximately 1.0 millimeter. Also preferably, each of the channels or pockets 228*a* has an opening that is approximately the same shape and cross-section as each of the orifices 272*a* and 272*b*. The plate 270 is preferably welded to the first face 222 at four or more different locations around the perimeter of the plate 270.

Because the plate 270 has very low mass and is flexible, it responds very quickly with the incoming fluid by lifting up towards the end member 28 so that fluid that has not passed through the plate adds to the volume of the hydraulic shim. The plate 270 approximates a portion of a spherical shape as it pulls in a volume of fluid that is still under the plate 270 and in the passage 226. This additional volume is then added to the shim volume but whose additional volume is still on the first reservoir side of the sealing surface. One of the many benefits of the plate 270 is that pressure pulsations are quickly damped by the additional volume of hydraulic fluid that is added to the hydraulic shim in the first reservoir. This is because activation of the injector is a very dynamic event and the transition between inactive, active and inactive creates inertia forces that produce pressure fluctuations in the hydraulic shim. The hydraulic shim, because it has free flow in and restricted flow out of the hydraulic fluid, quickly dampens the oscillations.

The through hole or orifice diameter of the orifice 272*a* or 272*b* can be thought of as the effective orifice diameter of the plate instead of the lift height of the plate 270 because the plate 270 approximates a portion of a spherical shape as it lifts away from the first face 222. Moreover, the number of orifices and the diameter of each orifice determine the stiffness of the plate 270, which is critical to a determination of the pressure drop across the plate 270. Preferably, the pressure drop should be small as compared to the pressure pulsations in the first reservoir 32 of the thermal compensator. When the plate 270 has lifted approximately 0.1 mm, the plate 270 can be assumed to be wide open, thereby giving unrestricted flow into the first reservoir 32. The ability to allow unrestricted flow into the hydraulic shim prevents a significant pressure drop in the fluid. This is important because when there is a significant pressure drop, the gas dissolved in the fluid comes out, forming bubbles. This is due to the vapor pressure of the gas exceeding the reduced fluid pressure (i.e. certain types fluid take on air like a sponge takes on water, thus, making the fluid behave like a compressible fluid.) The bubbles formed act like little springs making the compensator "soft" or "spongy". Once formed, it is difficult for these bubbles to re-dissolve into the fluid. The compensator, preferably by design, operates between approximately 2 and 7 bars of pressure and it is believed that the hydraulic shim pressure does not drop significantly below atmospheric pressure. Thus, degassing of the fluid and compensator passages is not as critical as it would be without the plate 270. Preferably, the thickness of the plate 270 is approximately 0. 1 millimeter and its surface area is approximiately 110 millimeter squared ($mm^2$). Furthermore, to maintain a desired flexibility of the plate 270, it is preferable to have an array of approximately twelve orifices, each orifice having an opening of approximately 0.8 millimeter squared ($mm^2$), and the thickness of the plate is preferably the result of the square root of the surface area divided by approximately 94.

Disposed between the first piston 220 and the top 46 of the stack 100 is a ring like piston or second piston 240 mounted on the extension portion 230 so as to be axially slidable along the longitudinal axis A—A. The second piston 240 includes a third face 242 confronting the second face 224. The second piston 240 also includes a fourth face 244 distal to the third face 242 along the longitudinal axis A—A. The fourth face 244 includes a retaining boss portion 246 which also constitute a part of a retaining shoulder 248. The retaining boss portion 246 cooperates with a boss portion 211 (formed on an surface of the body 210 that faces the longitudinal axis A—A) so as to facilitate assembly of a flexible diaphragm 250 after the second piston 240 has been installed in the second end 210*b* of the body 210. Preferably, the pistons are circular in shape, although other shapes, such as rectangular or oval, can also be used for the first piston 220 and second piston 240.

The second reservoir 33 is formed by a volume, which is enclosed by the flexible diaphragm 250. The diaphragm 250 is located between the second face 224 of the first piston 220 and the second piston 240. The flexible diaphragm 250 can be of a one-piece construction or of two or more portions affixed to each other by a suitable technique such as, for example, welding, bonding, brazing, gluing and preferably laser welding. Preferably, the flexible diagram 250 includes a first strip 252 and second strip 254 affixed to each other.

The flexible diaphragm 250 can be affixed to the first piston 220 and to an inner surface of the body 210 by a suitable technique as noted above. One end of the first strip 252 is affixed to the reduced portion 227 of the first piston 220 whereas another end of the second strip 254 is affixed to an inner surface of the body 210. Where the body 210 is of a one-piece construction, the another end can be affixed directly to the inner surface of the body 210. Preferably, where the body 210 includes two or more portions coupled to each other, the another end of the second strip 254 is affixed to one or the other portions prior to the portions constituting the body 210 being affixed together by a suitable technique.

The spring 260 is confined between the end cap 214 and the second piston 240. Since the second piston 240 is movable relative to the end cap 214, the spring 260 operates to push the second piston 240 against the flexible diaphragm 250. The second piston 240 impinges on the flexible diaphragm 250, which then forms a second working surface 248 with a surface area that is less than the surface area of the first working surface. Because the third face 242 impinges against the flexible diaphragm 250, the working surface 248 can be thought of as having essentially the same surface area as the third face 242.

This causes a pressure increase in the fluid 36 in the second fluid reservoir 33. In an initial condition, hydraulic fluid 36 is pressurized as a function of the product of the spring force and the surface area of the second working surface 248. Prior to any expansion of the fluid in the first reservoir 32, the first reservoir is preloaded so as to form a hydraulic shim. Preferably, the spring force of the spring 260 is approximately 30 Newton to 70 Newton.

The fluid 36 that forms a volume of hydraulic shim tends to expand due to an increase in temperature in and around the thermal compensator. The increase in volume of the shim acts directly on the first outer surface or first face 222 of the first piston. Since the first face 222 has a greater surface area than the second working surface 248, the first piston tends to move towards the stack or valve closure member 40. The force vector (i.e. having a direction and magnitude) "$F_{out}$" of the first piston 220 moving towards the stack is defined as follows:

$$F_{out}=(A_{shim}*P_{shim})-F_{spring}$$

where:

$F_{out}$=Applied Force (To the Piezo Stack)

$F_{spring}$=Total Spring Force $A_{shim}=(\pi/4)*Pd^2$ or Area above piston where Pd is first piston diameter (Hydraulic Shim)

At rest, the respective pressure of the pressures in the hydraulic shim and the second fluid reservoir tends to be generally equal. However, when the solid-state actuator is energized, the pressure in the hydraulic shim is increased because the fluid 36 is incompressible as the stack expands. This allows the stack 100 to have a stiff reaction base in which the valve closure member 40 can be actuated so as to inject fuel through the fuel outlet 62.

Preferably, the spring 260 is a coil spring. Here, the pressure in the fluid reservoirs is related to at least one spring characteristic of each of the coil springs. As used throughout this disclosure, the at least one spring characteristic can include, for example, the spring constant, spring free length and modulus of elasticity of the spring. Each of the spring characteristics can be selected in various combinations with other spring characteristic(s) so as to achieve a desired response of the compensator assembly 200.

Referring to FIG. 2B, the second piston 240' is mounted in a "nested" arrangement of a compensator assembly 200, 300 that differs from the pistons arrangement of the compensator assembly 200 of FIG. 2A. In FIG. 2B, the nested arrangement requires that the first piston 220' includes a piston skirt 221 of sufficient dimensions so as to permit a spring 260' and the second piston 240 to be installed within a volume defined by the piston skirt 221. The axial extent of the skirt 221 along the longitudinal axis A—A should be of a sufficient length so as to permit a spring 262 to be compressed and mounted within the piston skirt 221 without binding or interference between the springs or other parts of the pistons. The first piston 220' also includes an elongated portion 223 that allows the first piston 220' to be coupled to by a suitable coupling to the extension portion 230'. The elongated portion 223 also cooperates with the skirt 221 to define a volume for receipt of the spring 262. The spring 262 is operable to push the second piston 240' against a flexible diaphragm 250'. The flexible diaphragm 250' is attached by any suitable technique (such as those described with reference to flexible diaphragm 250) to the first piston 220 and to the end cap 214'. Preferably, the flexible diaphragm 250' is of a one-piece construction. It should be noted that although the compensator 200, 300 operates similarly to the compensator 200, one of the many aspects in which the embodiment of FIG. 2B differs from that of the embodiment of FIG. 2A is in the direction at which the second piston (240 in FIG. 2A and 240' in FIG. 2B) moves due to the spring force. In FIG. 2A, the spring force causes the piston to move towards the inlet end of the injector whereas in FIG. 2B, the spring force causes the second piston 240' to move towards the outlet end. Like the second piston 220 of FIG. 2A, the second piston 220' of FIG. 2B is preferably not in physical contact with the fluid 36. The second piston 220', by impinging its face 229' against the flexible diaphragm 250' (which is in physical contact with the fluid 36) causes the flexible diaphragm 250' to transfer the spring force to the fluid 36 through a second working surface 248' of the diaphragm 250'. Another aspect of the compensator 200, 300 includes an overall axial length that is more compact than that of the compensator assembly 200.

The compensator 200' of FIG. 2B can be simplified by eliminating the pressure responsive valve and the fluid passage that extends through the first piston. This simplification results in another preferred embodiment, shown here in FIG. 4, as a thermal compensator 300. The thermal compensator 300 includes a body 310 surrounding a first piston 320 that has a piston skirt 324. The piston skirt 324 is disposed a facing arrangement with an inner surface 312 of the body 310 that presents a gap 326 therebetween. A second piston 340 is disposed at least partly within the piston skirt 324. The second piston 340 includes a working face 342 and an extension 344 that extends through an opening 316 of the end cap 314. To generally prevent fluid 36 from entering the volume between the nested pistons, a sealing member 352 is disposed in a groove formed on either the skirt of the first piston or on an exterior portion of the second piston, which for clarity, only one side of the sealing member 352 is shown. The sealing member can be a diaphragm coupled to the skirt 324 and the second piston 340 or the extension portion 344 thereof. Preferably, the sealing member 352 is an O-ring. To generally prevent fluid from escaping a second reservoir 33, a seal 318 can be formed between the end cap 314 and the extension 344 of the second piston 340. Specifically, a groove can be formed into either the end cap 314 or the extension 344. The O-ring 318 is then mounted in the groove. Preferably, the groove 319 is formed on a peripheral surface of end cap 314 that faces the longitudinal axis A—A.

A first fluid reservoir 32 is formed between a face 322 and an end member 28. A second fluid reservoir 33 is formed between the working face 342 and the body. The first fluid reservoir 32 is in fluid communication with the second fluid reservoir 33 via a controlled clearance or gap 326. Preferably, the gap 326 should be of a suitable clearance so as to a controlled clearance that allows lubrication of the piston and the body while also forming a hydraulic seal that controls the amount of fluid leakage through the clearance or gap 326.

An internal filling passage 332 (similar in operating principle to the internal passage 232 of FIG. 2B) extends between a first port 332*a* and a second port 332*b*. A seal 350 is formed to preclude ingress or egress of fluid to the first reservoir 32 when a surface 350*a* of the first piston 320 contacts a surface 350*b* of the extension portion 330. At least one spring 360 is disposed within an internal volume of the first piston 320. The at least one spring 360 biases the second piston 340 away from the first piston 320. This applies a force to the fluid 36 through a surface area of the working surface 342, resulting in a first pressure that is transmitted to the first face 322 of the first piston 320. The first pressure can be designated as a pressure that permits the first reservoir to act as a hydraulic shim. Subsequent volumetric changes to the fluid 36 (due to thermal changes) in the first or second reservoir would cause the first piston to move along the longitudinal axis. This is believed to maintain the solid state actuator in a fixed spatial relation with various components of the fuel injector.

Figure 4:
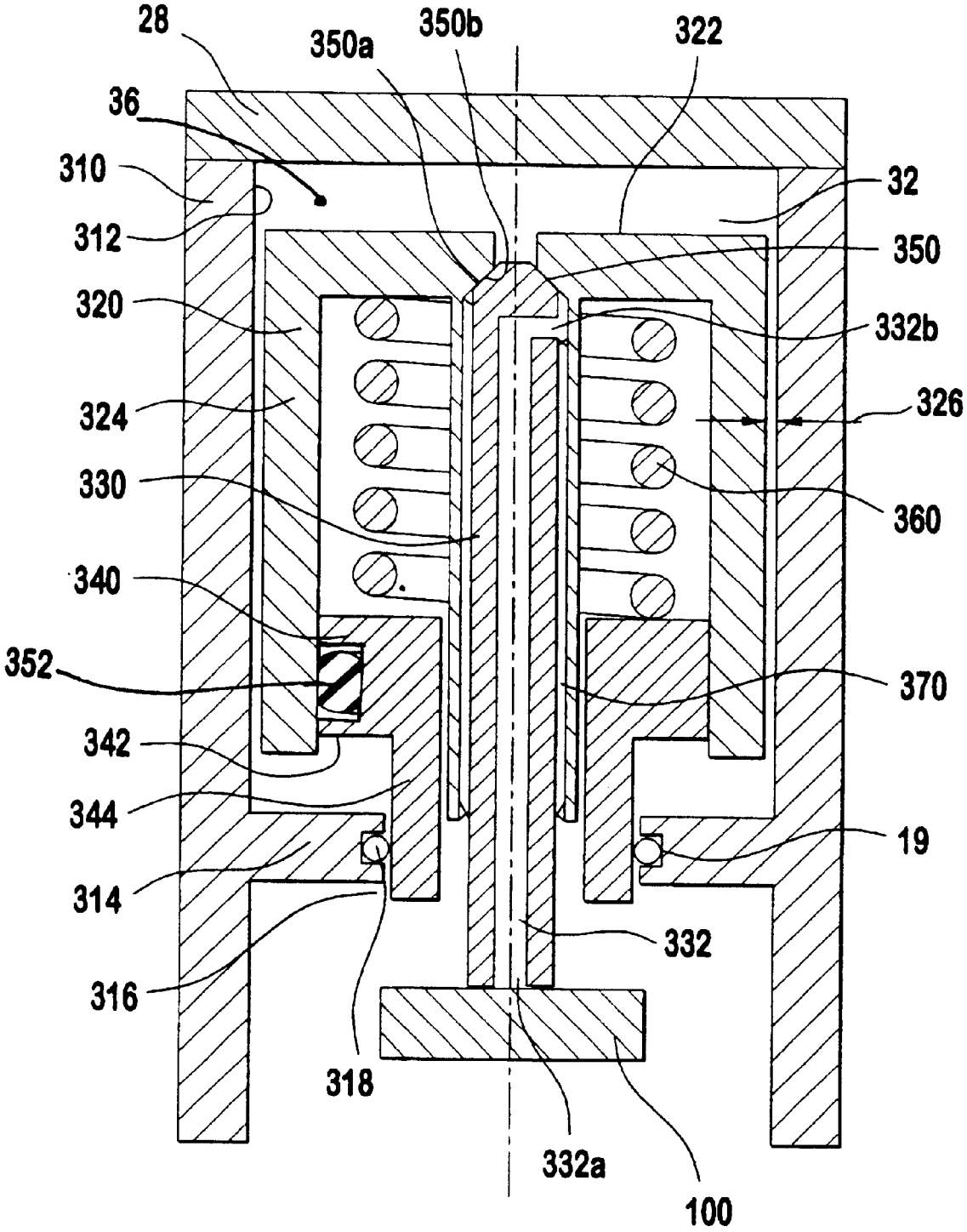
FIG. 4 is an illustration of another embodiment utilizing the nested configuration of FIG. 2B.

The force $F_{out}$ applied to the actuator stack 100 of the embodiment shown in FIG. 4 is defined as follows:

$$F_{out}=(F_{spring360}\pm F_{seal352}\pm F_{seal318})*(A_{shim}/A_{reservoir33})-F_{spring}\pm F_{seal352}$$

Where:

$F_{out}$=Force applied to stack 100

$F_{spring360}$=Force of spring 360

$F_{seal352}$=Friction force of seal 352

$F_{seal318}$=Friction force of seal 318

$A_{shim}=(\pi/4) * Pd^2$ or Area above piston where Pd is first piston diameter (Hydraulic Shim)

$A_{reservoir33}$=Area of the second reservoir 33

Referring again to FIG. 1, during operation of the fuel injector 10, fuel is introduced at fuel inlet 24 from a fuel supply (not shown). Fuel at fuel inlet 24 passes through a fuel filter 11, through a passageway 18, through a passageway 20, through a fuel tube 22, and out through a fuel outlet 62 when valve closure member 40 is moved to an open configuration.

In order for fuel to exit through fuel outlet 62, voltage is supplied to solid-state actuator stack 100, causing it to expand. The expansion of solid-state actuator stack 100 causes bottom 44 to push against valve closure member 40, allowing fuel to exit the fuel outlet 62. After fuel is injected through fuel outlet 62, the voltage supply to solid-state actuator stack 100 is terminated and valve closure member 40 is returned under the bias of spring 48 to close fuel outlet 62. Specifically, the solid-state actuator stack 100 contracts when the voltage supply is terminated, and the bias of the spring 48 which holds the valve closure member 40 in constant contact with bottom 44, also biases the valve closure member 40 to the closed configuration.

During engine operation, as the temperature in the engine rises, inlet fitting 12, injector housing 14 and valve body 17 experience thermal expansion due to the rise in temperature while the solid-state actuator stack experience generally insignificant thermal expansion. At the same time, fuel traveling through fuel tube 22 and out through fuel outlet 62 cools the internal components of fuel injector assembly 10 and causes thermal contraction of valve closure member 40. Referring to FIG. 1, as valve closure member 40 contracts, bottom 44 tends to separate from its contact point with valve closure member 40. Solid-state actuator stack 100, which is operatively connected to the bottom surface of first piston 220 (or 220'), is pushed downward. The increase in temperature causes inlet fitting 12, injector housing 14 and valve body 17 to expand relative to the piezoelectric stack 100 due to the generally higher volumetric thermal expansion coefficient β of the fuel injector components relative to that of the piezoelectric stack. Since the fluid is, in this case, expanding, pressure in the first fluid reservoir therefore must increase. Because of the virtual incompressibility of fluid and the smaller surface area of the second working surface 248 (or 248'), the first piston 220 (or 220') is moved relative to the second piston 240 (or 240') towards the outlet end of the injector 10. This movement of the first piston 220 (or 220') is transmitted to the piezoelectric stack 100 by the extension portion 230 (or 230'), which movement is believed to maintain the position of the piezoelectric stack constant relative to other components of the fuel injector such as the inlet cap 14, injector housing 14 and valve body 18. It should be noted that in the preferred embodiments, the thermal coefficient P of the hydraulic fluid 36 is greater than the thermal coefficient P of the piezoelectric stack. Here, the compensator assembly 200 (or 200, 300) can be configured by at least selecting a hydraulic fluid with a desired coefficient β and selecting a predetermined volume of fluid in the first reservoir such that a difference in the expansion rate of the housing of the fuel injector and the piezoelectric stack 100 can be compensated by the expansion of the hydraulic fluid 36 in the first reservoir.

During subsequent fluctuations in temperature around the fuel injector assembly 100, any further expansion of inlet fitting 14, injector housing 14 or valve body 17 causes the fluid 36 to expand or contract in the first reservoir. Where the fluid is expanding, the first piston 220 (or 220') is forced to move towards the outlet end of the fuel injector since the first face 222 (or 222') has a greater surface area than the second working surface 248 (or 248'). On the other hand, any contraction of the fuel injector components would cause the hydraulic fluid 36 in the first reservoir 32 (or 32') to contract in volume, thereby retracting the first piston 220 (or 220') towards the inlet of the fuel injector 10.

When the actuator 100 is energized, pressure in the first reservoir 32 increases rapidly, causing the plate 270 to seal tight against the first face 222. This blocks the hydraulic fluid 36 from flowing out of the first fluid reservoir to the passage 236. It should be noted that the volume of the shim during activation of the stack 100 is related to the volume of the hydraulic fluid in the first reservoir at the approximate instant the actuator 100 is activated. Because of the virtual incompressibility of fluid, the fluid 36 in the first reservoir 32 approximates a stiff reaction base, i.e. a shim, on which the actuator 100 can react against. The stiffness of the shim is believed to be due in part to the virtual incompressibility of the fluid and the blockage of flow out of the first reservoir 32 by the plate 270. Here, when the actuator stack 100 is actuated in an unloaded condition, it extends by approximately 60 microns. As installed in a preferred embodiment, one-half of the quantity of extension (approximately 30 microns) is absorbed by various components in the fuel injector. The remaining one-half of the total extension of the stack 100 (approximately 30 microns) is used to deflect the closure member 40. Thus, a deflection of the actuator stack 100 is believed to be constant as it is energized time after time, thereby allowing an opening of the fuel injector to remain the same.

When the actuator 100 is not energized, fluid 36 flows between the first fluid reservoir and the second fluid reservoir while maintaining the same preload force $F_{out}$. The force $F_{out}$ is a function of the spring 260 (or 262), and the surface area of each piston. Thus, it is believed that the bottom 44 of the actuator stack 100 is maintained in constant contact with the contact surface of valve closure end 42 regardless of expansion or contraction of the fuel injector components.

Although the compensator assembly 200, 200' or 300 has been shown in combination with a solid-state actuator for a fuel injector, it should be understood that any length-changing actuator, such as, for example, an electrorestrictive, magnetorestrictive or a solid-state actuator, could be used with the thermal compensator assembly 200, 200' or 300. Here, the length changing actuator can also involve a normally deenergized actuator whose length is expanded when the actuator energized. Conversely, the length-changing actuator is also applicable to where the actuator is normally energized and is de-energized so as to cause a contraction (instead of an expansion) in length. Moreover, it should be emphasized that the thermal compensator assembly 200, 200' or 300 and the length-changing actuator are not limited to applications involving fuel injectors, but can be for other applications requiring a suitably precise actuator, such as, to name a few, switches, optical read/write actuator or medical fluid delivery devices.

While the present invention has been disclosed with reference to certain preferred embodiments, numerous modifications, alterations, and changes to the described embodiments are possible without departing from the sphere and scope of the present invention, as defined in the appended claims. Accordingly, it is intended that the present invention not be limited to the described embodiments, but that it have the full scope defined by the language of the following claims, and equivalents thereof.

What is claimed is:

1. A fuel injector, the fuel injector comprising:

a housing having a first housing end and a second housing end extending along a longitudinal axis, the housing having an end member located between the first housing end and second housing end;

a length-changing actuator disposed in the housing along the longitudinal axis;

a closure member coupled to the actuator, the closure member being movable between a first configuration permitting fuel injection and a second configuration preventing fuel injection; and a compensator assembly that moves the length-changing actuator with respect to the housing in response to temperature changes, the compensator assembly including:

a body having a first body end and a second body end extending along a longitudinal axis, the body having an inner surface facing the longitudinal axis;

a first piston coupled to the length-changing actuator and disposed in the body proximate one of the first body end and second body end, the first piston having a first outer surface and a first working surface distal to the first outer surface, the first outer surface cooperating with the end member of the housing of the fuel injector to define a first fluid reservoir in the body;

a second piston disposed in the body proximate the first piston, the second piston having a second outer surface distal to a second working surface that confronts the first working surface of the first piston;

a second fluid reservoir disposed between the first working surface and the second working surface;

a communication passage disposed between the first fluid reservoir and the second fluid reservoir; and an extension portion having a first extension end coupled to one of the first piston and second piston and a second extension end coupled to the length-changing actuator, the extension portion including a fill passage disposed within the extension portion so as to supply hydraulic fluid to the communication passage and the first and second fluid reservoirs.

2. The fuel injector of claim 1, further comprising a valve disposed in one of the first and second reservoir, the valve being responsive to one of a first fluid pressure in the first fluid reservoir and a second fluid pressure in the second reservoir so as to permit fluid flow from one of the first and second fluid reservoirs to the other of the first and second fluid reservoirs.

3. The fuel injector of claim 1, wherein the second piston comprises an annulus disposed about the longitudinal axis, the annulus including a first surface proximal the longitudinal axis and a second surface distal therefrom.

4. The fuel injector of claim 3, further comprising a spring member being disposed within the body, and a flexible fluid barrier coupled to one of the first and second pistons and to the body inner surface so as to define the second fluid reservoir.

5. The fuel injector of claim 4, wherein the first piston comprises a first surface area in contact with the fluid and the flexible fluid barrier comprises the second working surface, the second working surface having a second surface area in contact with the fluid such that a resulting force is a function of the sum of the force of the spring member and a ratio of the first and second surface areas.

6. The fuel injector of claim 5, wherein the flexible fluid barrier includes a first strip hermetically sealed to a portion of the first working surface and a second strip hermetically sealed to a portion of the body inner surface, the first and second strips being located between the first working surface of the first piston and the second working surface of the second piston.

7. The fuel injector of claim 3, wherein the first piston includes a piston skirt extending from the first outer surface along the longitudinal axis, the piston skirt including an outer shell and an inner shell, the inner shell being coupled to the extension portion.

8. The fuel injector of claim 7, wherein the second piston comprises an annulus having a first surface and a second surface extending along the longitudinal axis, the first surface of the annulus facing the extension portion, the second surface facing the outer shell of the piston skirt, the annulus reciprocable into and out of the outer shell of the piston skirt.

9. The fuel injector of claim 8, wherein the flexible fluid barrier comprises a member having a first end coupled to the outer shell of the piston skirt and a second end coupled to an end cap portion, the end cap portion extending from the inner surface of the body towards the longitudinal axis.

10. The fuel injector of claim 3, wherein the first piston comprises a plurality of pockets disposed on the first outer surface of the first piston about the longitudinal axis.

11. The fuel injector of claim 10, wherein the valve comprises a plate, wherein the plate includes a plurality of orifices formed thereon, and the plate is exposed to the first fluid reservoir such that the plate projects over one of the first and second outer surfaces and whose thickness is approximately 1/94 of the square root of the surface area of one side of the plate.

12. The fuel injector of claim 11, wherein the plate includes a plurality of orifices disposed in a confronting arrangement with the plurality of pockets on the first outer surface of the first piston.

13. The fuel injector of claim 1, wherein the first piston comprises an exterior first piston surface contiguous to the body inner surface so as to permit leakage of hydraulic fluid between the first and second fluid reservoirs.

14. A hydraulic compensator for a length-changing actuator, the length-changing actuator having first and second ends, the hydraulic compensator comprising:

an end member;

a body having a first body end and a second body end extending along a longitudinal axis, the body having an inner surface facing the longitudinal axis;

a first piston coupled to the length-changing actuator and disposed in the body proximate one of the first body end and second body end, the first piston having a first outer surface and a first working surface distal to the first outer surface, the first outer surface cooperating with the end member of the housing of the fuel injector to define a first fluid reservoir in the body;

a second piston disposed in the body proximate the first piston, the second piston having a second outer surface distal to a second working surface confronting the first working surface of the first piston;

a second fluid reservoir disposed between the first working surface and the second working surface;

a communication passage disposed between the first fluid reservoir and the second fluid reservoir; and an extension portion coupled to one of the first piston and second piston, the extension portion including a fill passage disposed within the extension portion so as to supply hydraulic fluid to the communication passage and the first and second fluid reservoirs.

15. The compensator of claim 14, further comprising a valve disposed in one of the first and second reservoir, the valve being responsive to one of a first fluid pressure in the first fluid reservoir and a second fluid pressure in the second reservoir so as to permit fluid flow from one of the first and second fluid reservoirs to the other of the first and second fluid reservoirs.

16. The compensator of claim 14, wherein the second piston comprises an annulus disposed about the longitudinal axis, the annulus including a first surface proximal the longitudinal axis and a second surface distal therefrom.

17. The fuel injector of claim 16, further comprising a spring member being disposed within the body, and a flexible fluid barrier coupled to one of the first and second pistons and to the body inner surface so as to define the second fluid reservoir.

18. The fuel injector of claim 17, wherein the first piston comprises a first surface area in contact with the fluid and the flexible fluid barrier comprises the second working surface, the second working surface having a second surface area in contact with the fluid such that a resulting force is a function of the sum of the force of the spring member and a ratio of the first and second surface areas.

19. The compensator of claim 18, wherein the flexible fluid barrier includes a first strip hermetically sealed to a portion of the first working surface and a second strip hermetically sealed to a portion of the body inner surface, the first and second strips being located between the first working surface of the first piston and the second working surface of the second piston.

20. The compensator of claim 18, wherein the first piston includes a piston skirt extending from the first outer surface along the longitudinal axis, the piston skirt including an outer shell and an inner shell, the inner shell being coupled to the extension portion.

21. The compensator of claim 20, wherein the second piston comprises an annulus having a first surface and a second surface extending along the longitudinal axis, the first surface of the annulus facing the extension portion, the second surface facing the outer shell of the piston skirt, the annulus reciprocable into and out of the outer shell of the piston skirt.

22. The compensator of claim 21, wherein the flexible fluid barrier comprises a member having a first end coupled to the outer shell of the piston skirt and a second end coupled to an end cap portion, the end cap portion extending from the inner surface of the body towards the longitudinal axis.

23. The compensator of claim 14, wherein the first piston comprises a plurality of pockets disposed on the first outer surface of the first piston about the longitudinal axis.

24. The compensator of claim 23, wherein the valve comprises a plate, wherein the plate includes a plurality of orifices formed thereon, and the plate is exposed to the first fluid reservoir such that the plate projects over one of the first and second outer surfaces and whose thickness is approximately 1/64 of the square root of the surface area of one side of the plate.

25. The compensator of claim 24, wherein the plate includes a plurality of orifices disposed in a confronting arrangement with the plurality of pockets on the first outer surface of the first piston.

26. The compensator of claim 19, wherein the first piston comprises an exterior first piston surface contiguous to the body inner surface so as to permit leakage of hydraulic fluid between the first and second fluid reservoirs.

27. A method of compensating for thermal distortion of a fuel injector, the fuel injector including a housing having an end member, a body, the body having an inner surface facing the longitudinal axis, a first piston coupled to the length-changing actuator and disposed in the body, the first piston having a first outer surface and a first working surface distal to the first outer surface, the first outer surface cooperating with the end member of the housing of the fuel injector to define a first fluid reservoir in the body, a second piston disposed in the body proximate the first piston, a second fluid reservoir disposed between the first working surface and the second working surface, a communication passage disposed between the first fluid reservoir and the second fluid reservoir, and an extension portion coupled to one of the first piston and second piston, the extension portion including a fill passage disposed within the extension portion so as to supply hydraulic fluid to the communication passage and the first and second fluid reservoirs, the method comprising:

confronting a surface of the first piston to an inner surface of the body so as to form a controlled clearance between the first piston and the body inner surface;

coupling an flexible fluid barrier between the first piston and the second piston such that the second piston, the elastomer and the flexible fluid barrier form the second fluid reservoir;

biasing the second piston being disposed at least partly within the outer shell of the piston skirt so as to generate a hydraulic pressure in the first and second hydraulic reservoirs; and biasing the length-changing actuator with a predetermined vector resulting from changes in the volume of hydraulic fluid disposed within the first fluid reservoir as a function of temperature.

28. The method of claim 27, wherein biasing includes moving the length-changing actuator in a first direction along the longitudinal axis when the temperature is above a predetermined temperature.

29. The method of claim 27, wherein the biasing includes biasing the length-changing actuator in a second direction opposite the first direction when the temperature is below a predetermined temperature.

30. The method of claim 27, wherein the biasing of the actuator further comprises preventing communication of hydraulic fluid between the first and second fluid reservoirs during activation of the length changing actuator so as to capture a volume of hydraulic fluid in one of the first and second fluid reservoirs.

31. The method of claim 30, wherein the preventing further comprises releasing a portion of the hydraulic fluid in the one fluid reservoir so as to maintain a position of the closure member and a portion of the length changing actuator constant relative to each other when the length changing actuator is not energized.

* * * * *